US006238210B1

(12) United States Patent
Frydman et al.

(10) Patent No.: US 6,238,210 B1
(45) **Date of Patent: *May 29, 2001**

(54) FURNACES FOR REHEATING SIDERURGICAL PRODUCTS

(75) Inventors: Nathan Frydman, Medan; Frédéric Martin, Orsay; François Pahmer, Paris, all of (FR)

(73) Assignee: Stein Heurtey, Ris-Oranges (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/329,346

(22) Filed: Jun. 10, 1999

(30) Foreign Application Priority Data

Jun. 11, 1998 (FR) ..... 98 07374

(51) Int. Cl.[7] ..... F27B 9/00

(52) U.S. Cl. ..... 432/121; 432/122; 432/128; 432/239

(58) Field of Search ..... 432/11, 121, 122, 432/128, 129, 130, 131, 239, 136, 137; 198/775; 414/156; 266/249, 252, 274

(56) References Cited

U.S. PATENT DOCUMENTS

| | | | | |
|---|---|---|---|---|
| 3,304,210 | | 2/1967 | Löfström . | |
| 4,421,481 | * | 12/1983 | Holz et al. | 432/239 |
| 4,932,864 | * | 6/1990 | Miyabe | 432/128 |
| 5,002,009 | * | 3/1991 | Hayami et al. | 118/676 |
| 5,139,418 | * | 8/1992 | Rigan et al. | 432/122 |
| 5,607,144 | * | 3/1997 | Brun et al. | 266/249 |
| 5,766,382 | * | 6/1998 | Hertzog et al. | 148/656 |

FOREIGN PATENT DOCUMENTS

| | | |
|---|---|---|
| 27 23 626 | 11/1978 | (DE) . |
| 41 40 740 | 12/1992 | (DE) . |
| 0 704 664 | 4/1996 | (EP) . |

* cited by examiner

*Primary Examiner*—Jiping Lu
(74) *Attorney, Agent, or Firm*—Connolly Bove Lodge & Hutz

(57) ABSTRACT

A heating furnace reheats batches of iron steel products, which differ in their thermal state, introduced in succession into the furnace. The furnace has heating zones followed by at least two equalization zones, the products passing through at least one of these zones, at a speed different from that of the other zones. This speed can be adjusted depending on the thermal objective for the products to be reheated, and at least one of these zones is used as a heating zone.

6 Claims, 3 Drawing Sheets

FURNACES FOR REHEATING SIDERURGICAL PRODUCTS

FIELD OF THE INVENTION

The present invention relates to improvements made to a reheat furnace for iron and steel products with a view to reducing or eliminating any loss of production when reheating batches of different products introduced in succession into the furnace.

BACKGROUND OF THE INVENTION

It is known that reheat furnaces are intended to heat iron and steel products, such as slabs, blooms, billets, blanks or any other semi-finished product in the iron and steel industry, to the temperatures required for rolling.

It is also known that rolling, depending on the nature of the process used or on the final thickness of the finished product to be obtained, requires a heat treatment and a precise hardness of the product to be rolled. For a metal of a given chemical composition, this hardness depends on the temperature to which the product was heated.

The product temperatures required by the rolling operations are characterized by:

the average temperature of the product and the temperature uniformity of the product, for example between its upper face, its center and its lower face.

Precision in the thermal state (average temperature and temperature uniformity) of the products is imperative for high-quality rolling of steels, particularly high-carbon steels, stainless steels, ferritic and austenitic steels, silicon steels, etc.

The average temperature level is obtained by passing the products through so-called heating zones which are characterized by a large heat influx which produces significant thermal non-uniformity in the products.

The desired levels of temperature uniformity in the products are achieved by passing the products into an equalization zone in which the heat influx is very small, the products remaining therein for a controlled period, thereby allowing the temperatures within the products to be made uniform.

At the present time, the known reheat furnaces for iron and steel products, before rolling, are characterized by:

a large thermal inertia of the furnace, which limits rapid changes in the temperature of the latter, and the limited number of regulating zones in the furnace which, especially for construction reasons, does not allow the temperatures over the entire length of the furnace to be controlled precisely.

These two characteristics of the known reheat furnaces limit the flexibility of these furnaces as well as their capacity to reheat, in a continuous fashion, batches of different products, particularly with respect to their physical characteristics of:

charging temperature dimensions or shapes and steel grades, or batches of different products, particularly with respect to their thermal reheat objective, characterized by:

their discharge temperature the uniformity of the discharge temperature the presence of black lines the ignition losses the creep the decarburization or the heat treatment.

BRIEF DESCRIPTION OF THE DRAWINGS

The above-mentioned objects and advantages of the present invention will be more clearly understood when considered in conjunction with the accompanying drawings, in which.

DETAILED DESCRIPTION

Figure 1:
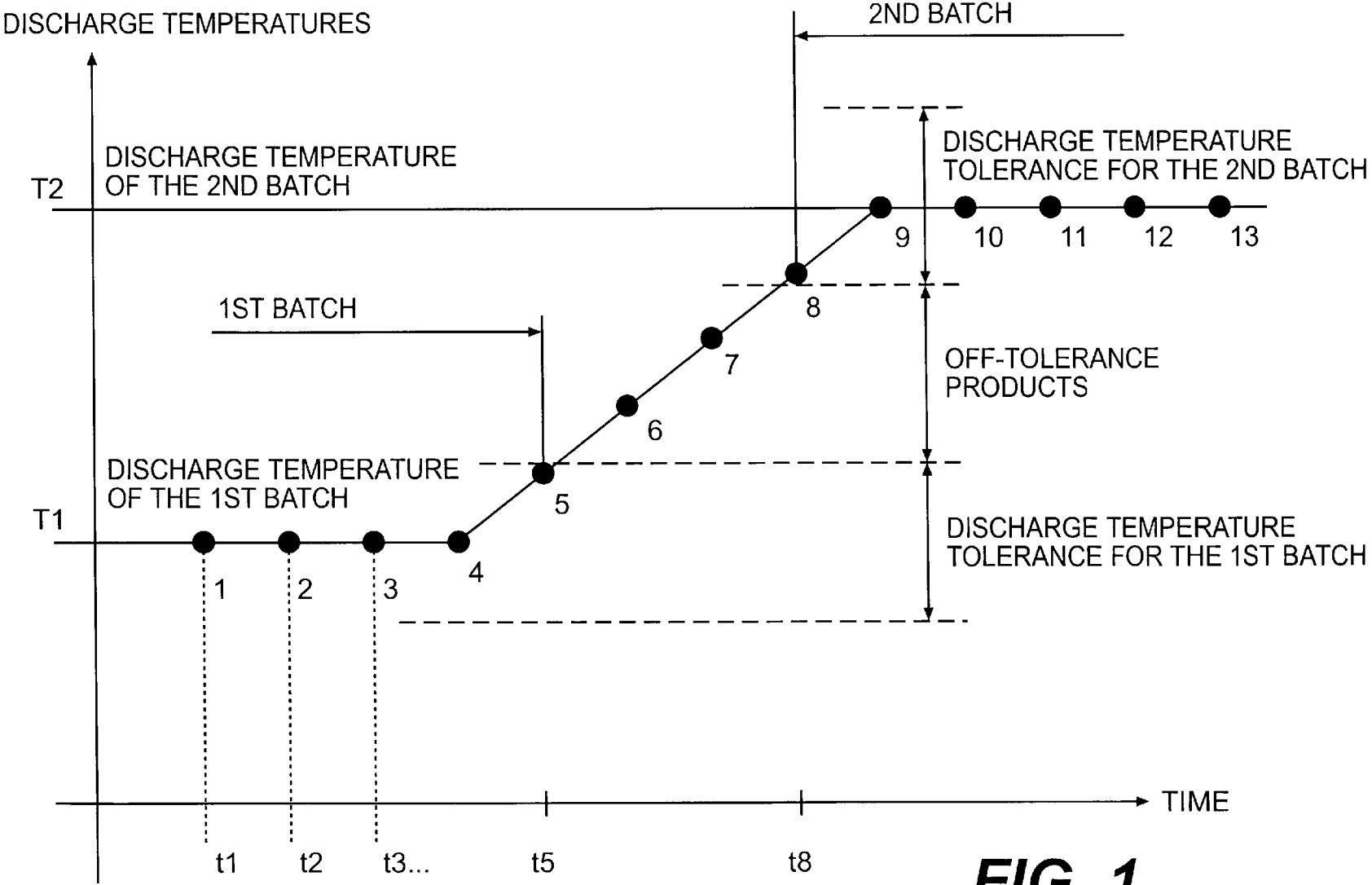
FIG. 1 is a plot illustrating an example of reheating of two batches of products with different discharge temperature objectives. The plot shows the discharge temperatures as a function of time.

FIG. 1 of the appended drawings is a diagram illustrating an example of the reheating of two batches of products with different discharge temperature objectives. This diagram shows the discharge temperatures as a function of time.

As may be seen in this diagram, the products of the first batch must be reheated to a temperature T1 and the products of the second batch must be reheated to a temperature T2. The products 1 to 5 belonging to the first batch are discharged at times t1 to t5 after having been heated to a temperature which lies within the tolerance range of the temperature T1. Likewise, the products 8 to 13 forming part of the second batch are discharged at times t8 to t13, after having been heated to a temperature lying within the tolerance range of the temperature T2.

The products 6 and 7, discharged in the time range between t5 and t8 have a temperature which lies outside the tolerances on the temperatures T1 and T2 and consequently may not be placed either in the first batch or in the second batch, and must therefore be downgraded or scrapped. To prevent such a loss of material at the present time, the furnace is not charged with the off-tolerance products 6 and 7. As a result, the places for these products constitute what is called a "hole" in the furnace-charging sequence. The presence of this hole entails a discontinuity in the discharging operation and in the rate of feeding the rolling mill placed downstream of the furnace between the times t5 and t8. This means that there is a loss of production corresponding to the time interval between two thermally acceptable products.

The principle explained above with reference to FIG. 1 for a discharge temperature T2 greater than the discharge temperature T1 can be transposed to the case in which the temperature T2 is less than T1. During the time required to go from the temperature T1 to the temperature T2, it will be necessary to leave "holes" in the charging sequence so as to omit those products whose thermal situation does not correspond either to the first batch or to the second batch.

The principle explained above for changing the temperature between two batches of products can also be transposed to any modification in the regulation of a furnace resulting from a modification in one or more physical characteristics of the products going from a first batch to a different second batch or a modification in their thermal objectives.

The "holes" constitute physical gaps between the various batches. They allow the zones of the furnace time to go from the zone temperature for one batch to the zone temperature for the next batch.

The holes have the drawback of causing significant loss of production, this being greater:

- the greater the difference between the thermal states of the first and second batches,
- the higher the required precision in the thermal state of the products of each batch at discharge,
- the greater the inertia of the furnace and
- the more frequent the batch-wise operating mode.

BRIEF DESCRIPTION OF THE INVENTION

Starting from this state of the art, the invention aims to provide improvements to a reheat furnace for iron and steel products, making it possible to reduce or eliminate production losses when reheating batches of products, which differ in their thermal state, introduced in succession into the furnace, these improvements being characterized in that the said furnace comprises heating zones followed by at least two equalization zones:

- it being possible for the products to pass through at least one of these zones at a speed different from that of the other zones, this speed being able to be adjusted depending on the thermal objective for the products to be reheated,
- it being possible for at least one of these zones to be used as a heating zone.

The present invention applies more particularly to a furnace for reheating billets, blooms, slabs, blanks or any other semi-finished product in the iron and steel industry.

DETAILED DESCRIPTION OF THE INVENTION

According to a preferred embodiment of the invention, at least two successive equalization zones are provided, at least one of which may be used for making the temperature of the products uniform.

Figure 2:
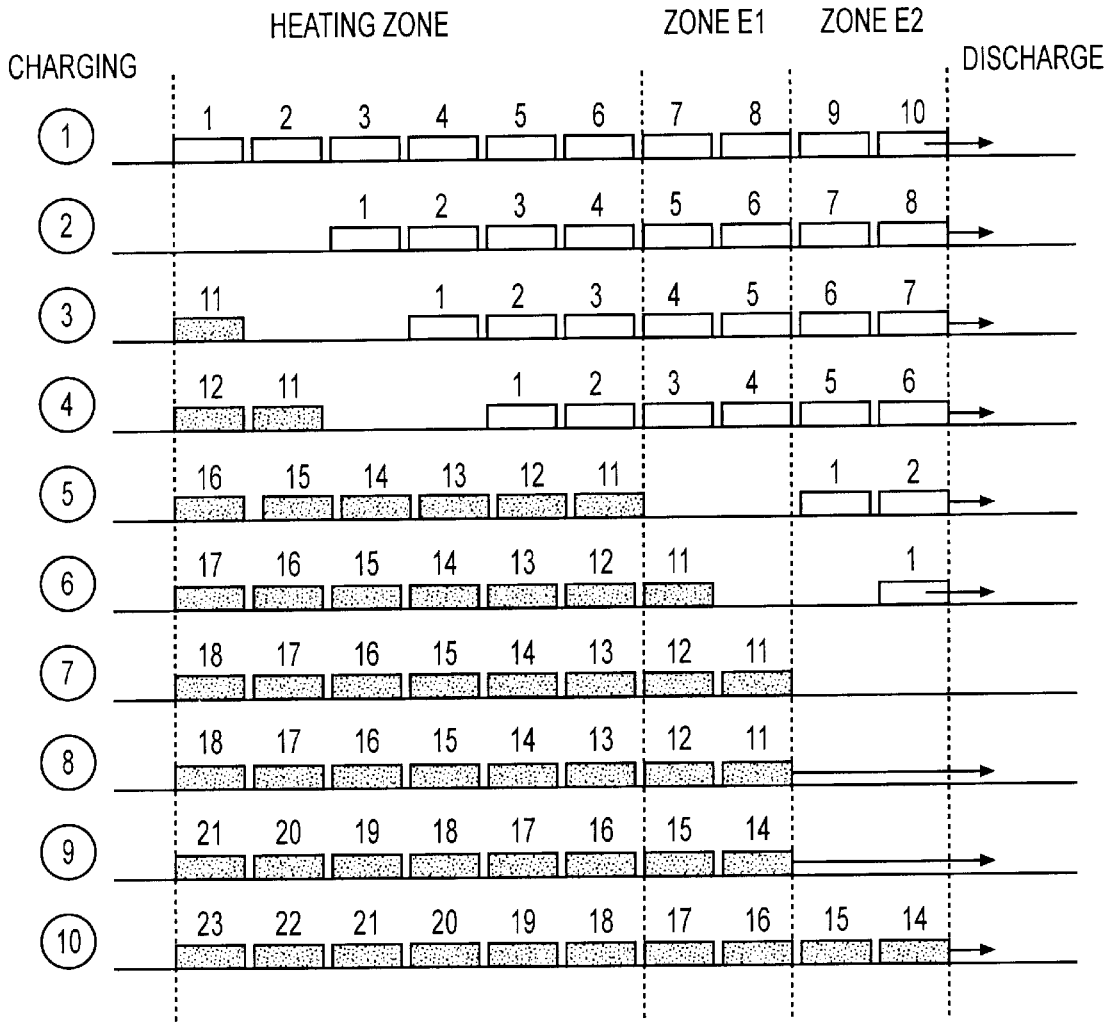
FIG. 2 illustrates the movement of different products through heat zones of a furnace.

FIG. 2 of the drawings illustrates the operating principle of a furnace to which the improvements forming the subject of the present invention have been made. This figure is a diagram in which the bed of products has been shown in the furnace opposite the heating zone or zones and opposite at least two equalization zones denoted by zone E1 and zone E2, respectively, these coming after the heating zone or zones. This diagram refers to an example of the operation of the furnace when going from a first batch of products, denoted by the labels 1 to 10, to a second batch of products, labelled 11 to 23.

The difference in the regulation of the zones of the furnace for reheating the products of the first batch and of the second batch may be dictated by one or more differences between the physical characteristics of the products of these two batches, by a difference between the thermal objectives for the products or by a difference regarding the requirements of the rolling plants lying downstream of the furnace.

The diagram in FIG. 2 refers to an example of the operation of the furnace relating to a reheating of two batches of products, the first batch being reheated to a temperature T1 and the second batch being reheated to a temperature T2, the temperature T2 being greater than the temperature T1. Those skilled in the art will understand that this principle can be easily transposed to the operation of the furnace for any modification in the regulation associated with the reheating of products whose physical characteristics or whose thermal objectives are different.

As may be seen below, according to the present invention the length of the "holes" in the furnace-charging sequence between two batches of products having different thermal objectives is minimized depending on the characteristics of the furnace, on the products and on the discharge rates, without creating any discontinuity in the discharging of the products from the furnace, and therefore without creating any loss of production.

Still referring to FIG. 2:

part (1) refers to the configuration of a batch of similar products introduced into the furnace, all the products 1–10 moving at the same speed and following a similar temperature curve during their passage through the furnace.

All the products of the batch are reheated until reaching the end of the zone E1 and are equalized during their passage through the zone E2. The zone E1 therefore behaves as a heating zone for the products of this batch.

In order to feed the rolling mill based downstream of the furnace, the discharge rate is constant: in this example, the product denoted by the label 10 is ready to be discharged;

parts (2) and (3) show the moment when the batch of products with which the furnace is being charged changes. A gap in the product loading constitutes a "hole" in the charging sequence between the first product of the first batch, denoted by the label 1, and the first product of the second batch, denoted by the label 11. The length of this "hole", clearly visible in FIG. 2, may be longer or shorter than the equalization zone E2. This length is defined depending on the difference between the thermal objectives for the products of the first batch and those of the second batch and depending on the inertia of the furnace. The rate of discharge of the products remains constant with the discharge of the products denoted by the labels 8 and 7, which have followed a temperature curve adapted to their thermal objective;

part (4) of the diagram in FIG. 2 shows how the "hole" moves depending on the advance of the bed of products in the furnace. The "hole" makes it possible to adapt the temperatures of the zones of the furnace to the thermal objectives for the products of the first batch and of the second batch;

part (5) shows the arrival of the first product of the second batch, denoted by the label 11, at the end of the heating zone. The control settings for the zone E1 are then modified so as to meet the thermal requirement of the products of the second batch;

part (6) shows the position of the bed of products in the furnace when the products of the second batch enter the zone E1 in order to be made uniform therein. The thermal state of these products will conform to the thermal objective fixed at the end of this zone. The rate of discharge of the products remains constant with the discharge of the last product of the first batch, denoted by the label 1, which has followed a temperature curve adapted to its thermal objective;

part (7) in FIG. 2 illustrates the arrival of the first product of the second batch, denoted by the label 11, at the end of the equalization zone E1. The products of the second batch have been reheated, bringing the first products of this batch, denoted by the labels 11 and 12, into a state close to their thermal objective. The equalization zone E2 is empty of any product and the control settings of this zone E2 may be modified so as to meet the thermal requirements of the products of the second batch;

part (8) represents the situation of the products of the second batch at the end of the zone E1. In order to maintain the rate of discharge of the products, it would be necessary to rapidly advance the bed of products through the furnace so as to place the product denoted by the label 11 in the discharge position. This rapid advance of the products entails moving the first products of the second batch into the zone E2, whose regulation does not correspond to these products, and a reduction in the residence time of the products within the furnace. The rapid advance of the products in the furnace results in a degradation of the thermal state of the products which are in the heating zones or in the equalization zone E2.

In order to avoid this problem, the invention provides the use of mechanical systems which ensure rapid transfer of the products through the last zone or zones of the furnace, so as to control the impact of this zone on the thermal state of the product transferred, or so as to limit or eliminate production losses despite the presence of the "holes" in the furnace-charging sequence. Likewise, mechanical systems are provided which allow the products to be rapidly discharged so as to control the impact of the last zone or zones of the furnace on the thermal state of the process. In the example illustrated by the diagram in FIG. 2, such rapid-transfer thermal equipment is used to discharge the product denoted by the label 11, this rapid transfer making it possible to maintain the rate of discharge from the furnace which is reheating the products of the second batch, in accordance with the fixed thermal objective.

According to the present invention, this rapid thermal transfer of one or more products may be obtained by:

- a long-travel discharge device which grips the product at the junction between the zones E1 and E2 so as to extract from the furnace;
- mechanical equipment for transferring the products in the furnace, the section of which corresponding to the zone E2 is made to undergo movements independent of the other sections constituting the other zones of the furnace. The section of the mechanical transfer equipment of the zone E2 makes it possible for a product to be discharged to be moved rapidly over the entire length of the zone E2 so as to place this product in a position allowing it to be removed by the discharge machine. The product may be discharged from the furnace to the front or to the side thereof.

Non-limiting illustrative examples of such mechanical equipment will be described below with reference to FIGS. 4 and 5 of the appended drawings. Of course, any other equivalent device may be used;

part (9) of the diagram in FIG. 2 illustrates an example of the operation of the furnace during the entire period in which the thermal conditions of the equalization zone E2 are incompatible with the objectives for the products of the second batch. During this period, the products denoted by the labels 12 and 13 are rapidly discharged by the mechanical equipment, which is provided for this purpose in the zone E2, as mentioned above, so as to feed the rolling mill.

After each product is discharged, the systems for supporting and transferring the products, which are provided in the heating zone or zones and in the zone E1 (and which will be described below with reference to FIGS. 4 and 5), move the bed of products for the furnace so as to bring a product into a stand-by position at the end of zone E1. In this example, the product denoted by the label 14 occupies this stand-by position;

part (10) refers to the operation of the furnace when the thermal conditions of the equalization zone E2 have become compatible with the thermal objectives for the products of the second batch.

The equalization zone E2 is used for making the temperatures of the products of the second batch uniform, the equalization zone E1 being used either for the equalization or for the end of the heating of the products.

The products of the second batch are transferred into the zone E2 in one or more stages so as to ensure that the thermal objective for the products of the second batch are maintained within the predefined tolerances.

Figure 3:
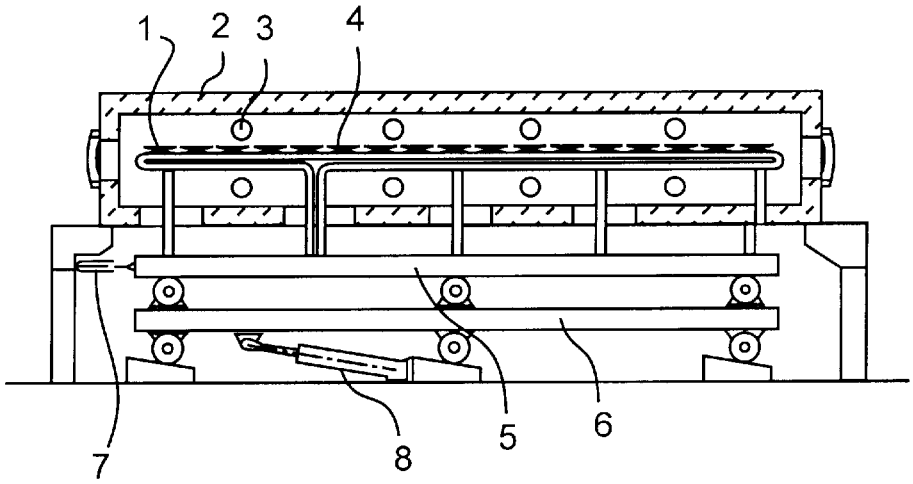
FIG. 3 is a diagrammatic side view of a first embodiment of a material transfer unit for iron and steel products.
Figure 4:
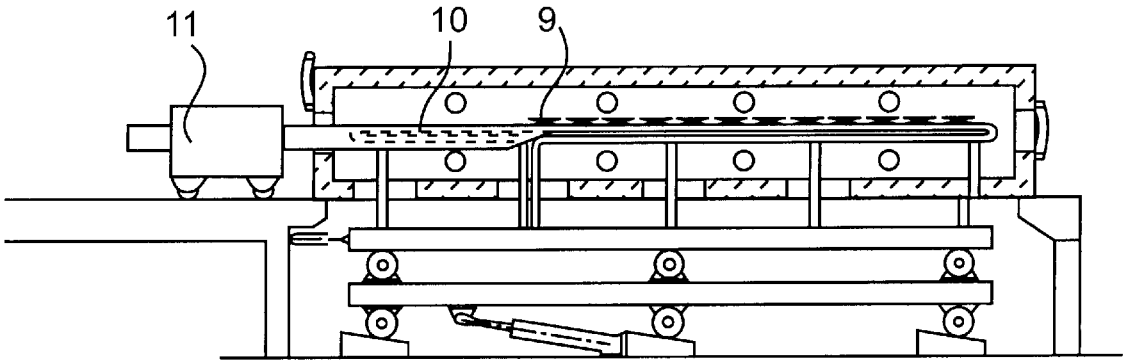
FIG. 4 is a diagrammatic side view of a second embodiment of a material transfer unit for iron and steel products.
Figure 5:
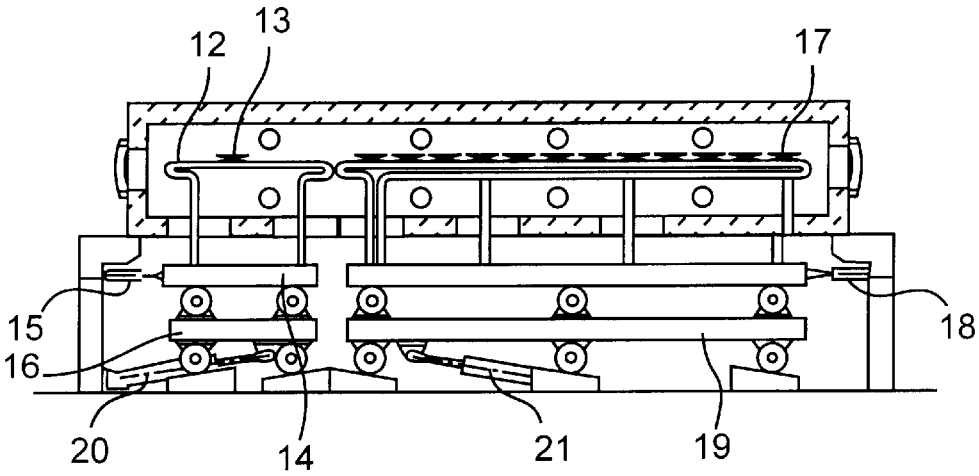
FIG. 5 is a diagrammatic side view of a third embodiment of a material transfer unit for iron and steel products.

Referring now to FIGS. 3 to 5, which show illustrative examples of mechanical systems used for moving the products translationally in the zone E2 of the furnace.

In these figures:

FIG. 3 is a diagrammatic side view of a conventional furnace for the reheating of iron and steel products, to which furnace the present invention applies.

FIG. 4 is a view similar to FIG. 3, illustrating a system allowing the functions of the invention defined above to be carried out and FIG. 5 is a view similar to FIGS. 3 and 4 illustrating another device for carrying out the functions of the invention.

Referring to FIG. 3, it may be seen that, in a furnace according to the conventional technique, the products to be reheated, denoted by the label 1, are treated in a thermally insulated enclosure 2 using burners shown diagrammatically at 3. The products are supported and transferred over the entire length of the furnace by means of fixed and movable longitudinal members denoted by the label 4. The movable longitudinal members are fastened to a frame 5 allowing them to move in horizontal translation, the whole assembly resting on a system consisting of a beam 6 itself resting on wheels able to move on blocks in the form of an inclined plane, this system being designed so as to allow the movable longitudinal members to undergo a lifting movement. The products are moved translationally by means of a cylinder 7 acting on the frame 5, while the lifting movement is carried out by means of a cylinder 8 which moves the frame 6 along the inclined planes. In such a furnace, the entire bed of products, such as 1, rests on a single item of support/transfer equipment, all the products of the bed moving at the same speed and over the same distance, with each movement of the said equipment.

According to the present invention, the functions which were mentioned in the description given above are carried out with the aid of mechanical systems which ensure that the products are rapidly transferred into the last zone or zones of the furnace, these mechanical systems being furthermore able to ensure that the products are discharged rapidly via the front or the side.

Referring now to FIG. 4, which shows a first illustrative example of a device allowing the functions of the invention to be carried out. This device essentially comprises arms denoted by the label 10 and actuated by a device 11 for the purpose of gripping the products. The arms, such as 10, therefore lie approximately level with the longitudinal members which are supporting and transferring the products. In the example illustrated by the drawing, the product to be discharged, denoted by the label 9, is located at the end of the equalization zone (E1) in FIG. 2 and is gripped by the arms 10 so as to be removed from the furnace in a single operation, in order to feed the rolling mill (not shown in the drawing). Thus, this system makes it possible to transfer the products rapidly into the last zone of the furnace, as well as to rapidly discharge them, so as to check the impact of the last zone or zones of the furnace on the thermal state of the product. It will be noted that the discharge system, consisting of the arms 10 and their actuating device 11, may be placed so as to ensure that a product gripped by the said system inside the furnace is removed via the front or via the side of the furnace, at a given point in its thermal cycle, for the purpose of removing it to the outside of the furnace, for example to a rolling mill (not shown in the drawing).

Referring now to FIG. 5, which depicts an illustrative example of a mechanical device allowing the functions of the invention to be carried out.

In this embodiment, an independent section is provided for supporting and transferring the products inside the furnace, this section allowing the supported product or products to be moved at a speed independent of that of the products supported and transferred by the other sections of the furnace, so as to limit or eliminate the impact of the "holes" in the charging of the furnace on the rate of discharge of the products.

In this FIG. 5, this section is denoted by the label 12. It may be moved translationally under the action of the cylinder 15 and lifted under the action of the cylinder 15 and lifted under the action of the frame 16 driven by the cylinders. The translational movement or all of the movements of the section 12 are carried out independently of the movements of the other sections 17 which are driven translationally by the cylinder 18 and lifted by the frame 19 driven by the cylinders.

In this FIG. 5, the product 13. to be discharged has been shown during transfer through the equalization zone E2, this high-speed transfer being carried out with the aid of the independent supporting section 12. Thus, the product 13 is transferred at high speed over the entire extent of the zone E2.

It will have been understood from reading the description above that the improvements made by the present invention ensure that the length of the "holes" in the furnace-charging sequence is minimized between two successive batches of iron and steel products having different thermal objectives, depending on the characteristics of the furnace, on the products and on the discharge rates, without there being any discontinuity in discharging the products, and therefore no loss of production.

Of course, it remains to be stated that the present invention is not limited to the illustrative embodiments described and/or given here but that it encompasses all variants falling within the scope of the invention, as defined by the appended claims.

What is claimed is:

1. A furnace for reheating batches of steel products having different thermal states and introduced successively into the furnace, the furnace production losses being limited when reheating batches in different thermal states, the furnace comprising:

an initial heating zone a plurality of successively located equalization zone means located downstream of the initial heating zone for equalizing the temperature throughout each product, the equalization zone means being selectively used as an auxiliary heating zone; and mechanical means for contacting preselected products and passing the preselected products through at least one of the equalization zones at an adjustable speed that is a function of the temperature to which the preselected product is to he heated;

wherein at least one of the equalization zones is selectively used as a heating zone.

2. The furnace of claim 1 wherein the mechanical means also rapidly discharges the preselected products.

3. The furnace of claim 1 wherein the mechanical means further comprises means for lifting a preselected product inside the furnace and selectively discharging it through the front or side of the furnace at a given point in the thermal cycle of the preselected product.

4. The furnace of claim 1 wherein the mechanical means further comprise arms for lifting the preselected products; and means for actuating the arms.

5. The furnace of claim 1 wherein the mechanical means further comprises an independent support means for supporting and transferring the preselected products inside the furnace, the support means moving the preselected products at a speed independent of the speed of other products moving in other sections of the furnace.

6. The furnace of claim 5 wherein the independent support means is moved translationally by a cylinder connected to the support means.

* * * * *